US005257080A

United States Patent [19]

Johroku et al.

[11] Patent Number: 5,257,080

[45] Date of Patent: Oct. 26, 1993

[54] IMAGE FORMING APPARATUS AND ITS DISCHARGE SYSTEM

[75] Inventors: Kazuo Johroku, Sakai; Masami Taniguchi, Osaka, both of Japan

[73] Assignee: Mita Industrial Co., Ltd., Japan

[21] Appl. No.: 914,558

[22] Filed: Jul. 17, 1992

[30] Foreign Application Priority Data

Jul. 24, 1991 [JP] Japan ..... 3-208666

[51] Int. Cl.[5] ..... G03G 21/00; G03G 15/00

[52] U.S. Cl. ..... 355/321; 271/184; 271/185; 271/302; 355/308

[58] Field of Search ..... 355/308, 309, 316, 317, 355/318, 321; 271/302, 303, 65, 184, 185, 186

[56] References Cited

U.S. PATENT DOCUMENTS 4,036,488 7/1977 Allen .
4,750,016 6/1988 Kusumoto et al. ..... 271/65
4,857,963 8/1989 Sutou ..... 355/321

FOREIGN PATENT DOCUMENTS 046675 3/1982 European Pat. Off. .
378177 7/1990 European Pat. Off. .
388851 9/1990 European Pat. Off. .
56-40547 4/1981 Japan .

*Primary Examiner*—A. T. Grimley
*Assistant Examiner*—Sandra L. Brasé
*Attorney, Agent, or Firm*—Beveridge, DeGrandi, Weilacher & Young

[57] ABSTRACT

A discharge system for discharging copy sheets out of a copying machine body comprises a transport unit and a discharge unit. The transport unit transports copy sheets in a transverse direction of the machine. The interiorly-incorporated discharge unit acquires a sheet transported from the transport unit and actively transports the acquired sheet along a fore-and-aft direction of the apparatus toward the user-directed side of the copying machine in order to discharge it exteriorly. The overall occupied space of the copy machine is thus reduced; additionally, accuracy of copy sheet discharge is ensured.

48 Claims, 16 Drawing Sheets

IMAGE FORMING APPARATUS AND ITS DISCHARGE SYSTEM

BACKGROUND OF THE INVENTION

This invention relates to an image forming apparatus, and to a discharge system in an image forming apparatus such as a copying machine, for discharging image-formed sheets from an image forming section out of the apparatus body.

Copying machines are provided with a discharge system in order to discharge copy sheets following an image forming process. The discharge system is located downstream, with respect to the sheet transportation direction, of the image forming section, which comprises a photoconductive drum and associated elements. The discharge system is principally composed of a sheet-discharge transportation part, which transports image-formed sheets to a side wall of the apparatus body, a discharge roller mounted along the side wall, and a tray for receiving sheets discharged by the discharge roller.

Conventional discharge units work with a copy receiving tray projecting out from one side of the image forming apparatus, such that the overall area occupied by the apparatus is extensive, and a wide space is taken up.

Japanese Utility Model Laying-Open No. 40547/1981 discloses a copying machine having an interior copy receiving tray, inclined such that its front part is lower than its rear part. In this case, sheets transported from the image forming section drop along the slope of the tray and are discharged toward the front side of the apparatus body.

Copying machines disclosed in Japanese Utility Model Laying-Open No. 746/1982 and Japanese Patent Laying-Open No. 106269/1988 are also provided with interior copy receiving trays. The machines take up less space in their lengthwise direction because the copy receiving tray of either is contained within the apparatus body.

However, in the copying machine disclosed in Japanese Utility Model Laying-Open No. 40547/1981, smaller-sized sheets tend not to reach the front end of the tray since they drop along the slope only under their own weight. Thus, the ends of the sheets discharged do not register well, hindering working performance in subsequent handling.

In the copying machines disclosed in Japanese Utility Model Laying-Open No. 746/1982 and Japanese Patent Laying-Open No. 106269/1988, copy sheet removal is hampered by the fact that the sheets are received into the copy receiving tray as positioned in the apparatus body. In the copying machine disclosed in Japanese Patent Laying-Open No. 106269/1988, it is necessary to withdraw a retractable tray in order to remove discharged copy sheets. Moreover, checking the outcome of copied sheets during a copying operation is therefore not practicable, and many faulty copies may be developed.

Furthermore therein, there are extractable feed cassette and a discharge cassette which require respective guide rails, adding to the number of components and complicating the structure.

The discharge cassette itself occupies one of the cassette housings, subtracting from that the number of feed cassettes that can be simultaneously installed into the copying machine body.

SUMMARY OF THE INVENTION

It is an object of the present invention to reduce the space occupied by an image forming apparatus and to improve ease of operation in the removal of copy sheets therefrom.

It is another object to reduce the space occupied by the discharge system of an image forming apparatus, and to facilitate inspection of copy quality.

It is still another object of the present invention to house, in a simple structure, feed cassette and a discharge cassette within the apparatus body such that the cassettes function as drawers.

It is a further object to allow for the installation of an increased number of feed cassettes into an image forming apparatus when so required.

(1) A discharge system according to the present invention is for discharging image-formed sheets from image forming section of an image forming apparatus out of the apparatus body. The discharge system comprises means for transporting sheets on which an image has been formed along a transverse direction of the apparatus, and discharge means for acquiring the sheets transported by the transportation means in an aquiring plane and then transporting the sheets toward the front side of the apparatus in a plane substantially parallel to aquiring plan, wherein the sheets are discharged out of the apparatus body.

The discharge system transports image-formed sheets in the transverse direction of the apparatus body to one end of the apparatus. The sheets are then set onto the front discharge means, and transported toward the front side of the apparatus by such means as a circulating belt, whereby the sheets are discharged out of the apparatus body.

Accordingly, this apparatus does not require a copy receiving tray installed on its side such that the longitudinal space occupied by the entire apparatus is reduced. The sheets are conducted out of the apparatus by the front discharge means, which improves handling when removing the sheets.

(2) According to another aspect of the present invention, an image forming apparatus comprises an image forming section which forms an image onto a sheet, at least one feed cassette containing sheets for supply to the image forming section, located below the image forming section and movable in the front-to-rear direction of the apparatus; feed transportation means for transporting the sheets from the feed cassette(s) to the image forming section, discharge means for transporting image-formed sheets from the image forming section to below the image forming section, and a discharge system located above the uppermost feed cassette for receiving the sheets transported by the discharge transportation means.

In this image forming apparatus, the discharge system and at least one feed cassette are provided below the image forming section. A sheet is transported to the image forming section by the feed transportation means, wherein an image is formed onto the surface of the sheet. Then, the sheet is transported to the discharge system located below the image forming section. Since the discharge system is located above the uppermost feed cassette, it is easy to inspect the outcome of the image-formed sheets during an image-forming operation.

(3) According to another aspect of the present invention, an image forming apparatus comprises an apparatus body, an image forming section located inside of the apparatus body which is for forming an image onto the surface of a recording sheet, cassette housings, feed transportation means, and discharge transportation means.

The cassette housings are located in the apparatus body, and provides the option of housing either a feed cassette or a discharge cassette. When a feed cassette is installed into the cassette housing, the feed transportation means transports sheets from the feed cassette to the image forming section. When the discharge cassette is installed into the cassette housing, the discharge transportation means transports image-formed sheets to the discharge cassette.

The cassette housing structure is accordingly simplified, being able to house either type of cassette, since the exterior dimensions of both kinds are identical. If the variety of sheet sizes to be employed is small, the discharge cassette can be installed into the cassette housing, with the sheet-feed cassette(s) installed into remaining cassette housings. In this way, the image forming apparatus is outfitted such that no cassettes extend from either side, whereby the total occupied space of the apparatus is reduced.

Meanwhile, if a wide variety of sheet sizes is to be employed, an additional feed cassette can be installed into the cassette housing wherein it replaces the discharge cassette. In this case, the sheets can be discharged by installing a discharge tray, on the side of the apparatus, for example, and switching over the discharge path.

These and other objects and advantages of the present invention will be more fully apparent from the following detailed description.

DESCRIPTION OF THE PREFERRED EMBODIMENT

Figure 1:
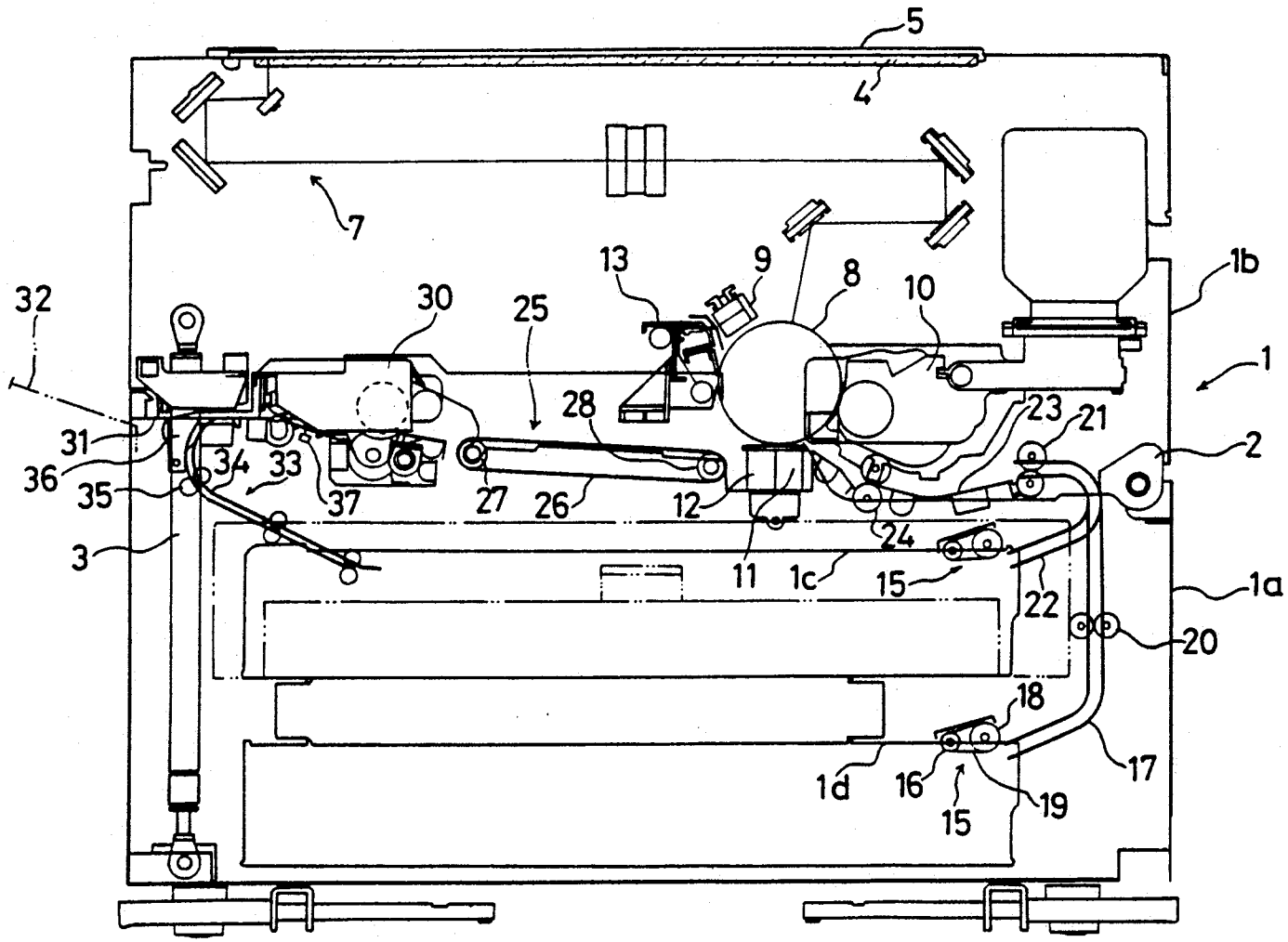
FIG. 1 is a schematic elevational view showing a copying machine incorporating an embodiment according to the present invention.

Reference is made to FIG. 1, illustrating a copying machine according to an embodiment of the present invention, wherein an apparatus body 1 is shown to be composed of a lower segment 1*a* and an upper segment 1*b* openably joined to the lower segment 1*a* by a hinge 2. The hinge 2 is provided along the right side in the figure of the apparatus body 1. In the left side stands a cylinder 3 which connects segments 1*a* and 1*b* together. Two receptacles 1*c* and 1*d* are formed one atop the other in the front side of the lower segment 1*a*. The upper receptacle 1*c* can detachably house a discharge unit, and the lower receptacle 1*d* can detachably house a feed cassette. The discharge unit and the feed cassette are therein installed and detached in the front-to-rear direction of the machine.

The upper surface of the apparatus body 1 contains a contact glass 4, and disposed thereon is an openable original holder 5. An optical exposure system 7 for obtaining image information from an original is located in the upper portion of the apparatus body 1. The exposure system 7 consists chiefly of a light source, mirrors, and lens units. Disposed in a central portion of the apparatus body 1 is a photoconductive drum 8 on which an electrostatic latent image is formed. Surrounding the photoconductive drum 8, there are a charger 9, a developing unit 10, a transfer unit 11, a detach unit 12 and a cleaning unit 13. The photoconductive drum 8 and the associated units constitute an image forming section.

A sheet feed unit 15 is provided along the upper right portion of the slot 1*d*. The sheet feed unit 15 is composed of a pick-up roller 16, which comes into contact with the uppermost sheet in the feed cassette and withdraws it; a feed roller 18, which delivers the withdrawn sheet to a sheet transport path 17; and a belt 19 wrapped around the pick-up roller 16 and the feed roller 18. A sheet transport path 17 extends from the right side of the slot 1*d* upward and, at the right side of the developing unit 10, curves inward of the apparatus body. Transport rollers 20 are provided in the middle of the sheet transport path 17, and transport rollers 21 are provided along the exit of the sheet transport path 17, at its upper end. Another sheet feed unit 15 is likewise provided along the upper right portion of receptacle 1*c*. Between this sheet feed unit 15 and the sheet transport path 17, a sheet transport path 22 is disposed. The sheet transport path 22 merges with the upstream portion of the sheet transport path 17. Another sheet transport path 23 is provided between the sheet transport path 17 and the image forming section containing the photoconductive drum 8, etc. Resist rollers 24 for controlling the sheet feed timing are provided at the end of the sheet transport path 23 near the image forming section. Each of the sheet transport paths 17, 22 and 23 consists of guide plates.

A discharge transport unit 25 is provided downstream in the sheet transportation direction alongside the image forming section, and it transports sheets toward the left side of the apparatus. The discharge transport unit 25 is principally composed of a circulation belt 26 which circulates in the transverse direction of the apparatus, a drive roller 27 and a driven roller 28. A fixing unit 30, a side discharge transport path 31 for discharging sheets to the left side of the apparatus and discharge rollers (not shown) are provided downstream of the discharge transport unit 25. A tray 32 for receiving exteriorly discharged sheets is connectable therein at the discharge end of the side discharge transport path 31. A turned transport unit 33 branches off of the side discharge transport path 31 and serve to guide sheets therefrom downward of the fixing unit 30, overturning them. The turned transport unit 33 consists of guide plates 34 which curve downward from the side discharge transport path 31, and a plurality of transport rollers 35 for transporting the sheets guided by the guide plates 34. The guide plates 34 slope out over a circulation belt 62 of a discharge unit (hereinafter described) such that the leading edge of a transported sheet does not strike against the circulation belt 62 but is smoothly slid onto the belt in order to be discharged. The discharge ends of the guide plates 34 extend over the left end portion of the circulation belt 62 such that the trailing end of a discharged sheet exits completely onto the circulation belt 62. A sheet transport switch 37 is provided downstream of the fixing unit 30 for detecting the transportation of sheets from the fixing unit 30.

Figure 2:
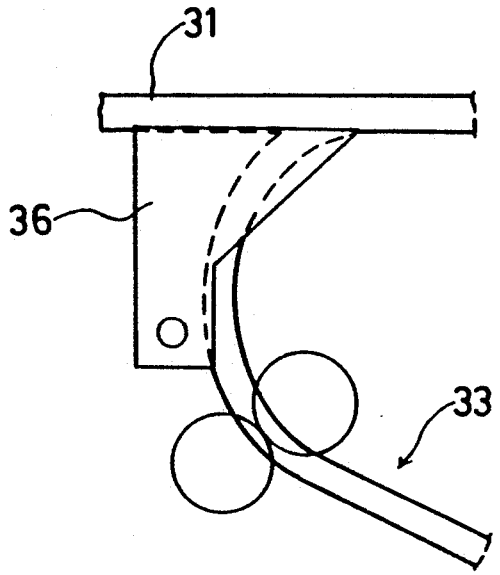
FIG. 2 is an enlarged view showing a switchover claw of the machine.
Figure 3:
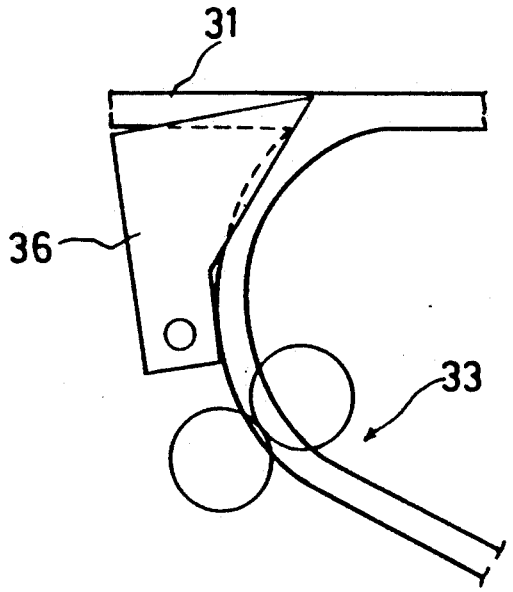
FIG. 3 is an enlarged view showing the switchover claw of FIG. 2 in another state.

A switchover claw 36 is provided along the junction of the side discharge transport path 31 and the turned transport unit 33, and in selection assumes either a side-discharging position as shown in FIG. 2, wherein a transported sheet is discharged through the side discharge transport path 31 out the side of the apparatus, or a front-discharging position as shown in FIG. 3, wherein the transported sheet is guided toward the turned transport unit 33.

Discharge Unit

The discharge unit 40, installed into the receptacle 1*c* in the front side of the apparatus body will be explained with reference to FIGS. 4 through 11.

Figure 9:
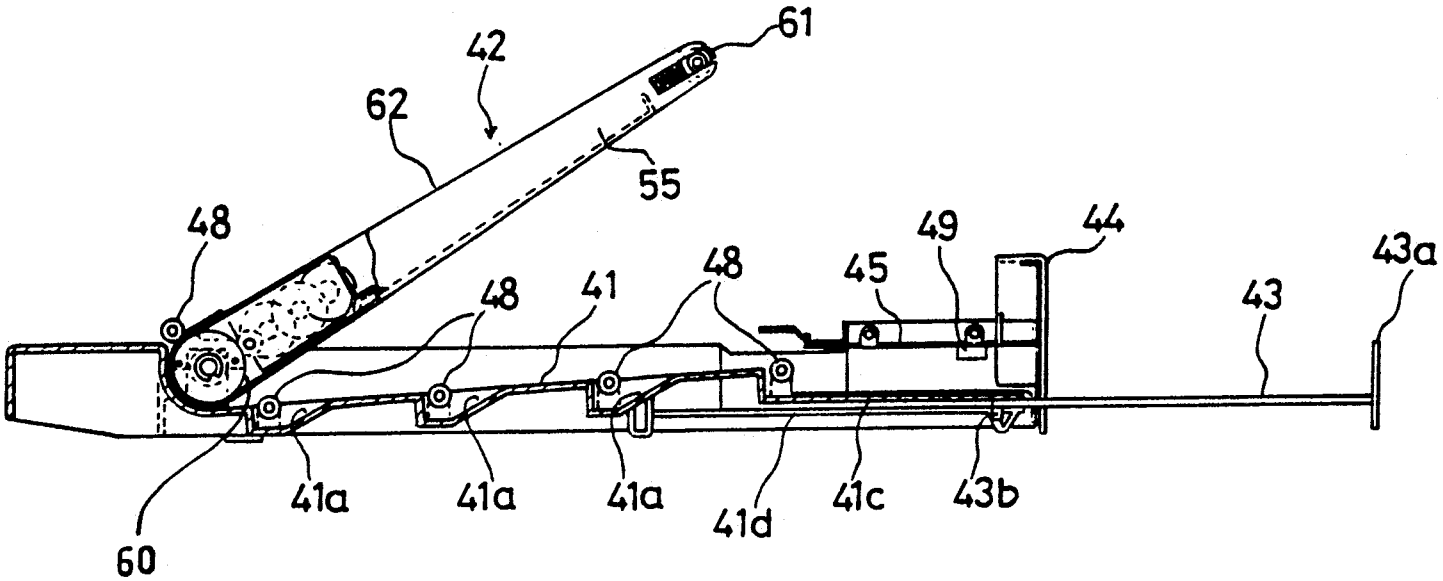
FIG. 9 is a vertical section view of the discharge unit.

The discharge unit 40, as shown in FIG. 9, is composed chiefly of a main frame 41, a drive unit 42 the rear end of which is pivotally connected with the main frame 41, and a discharge tray 43 which is insertable into the front end of the main frame 41 and can be withdrawn.

Figure 4:
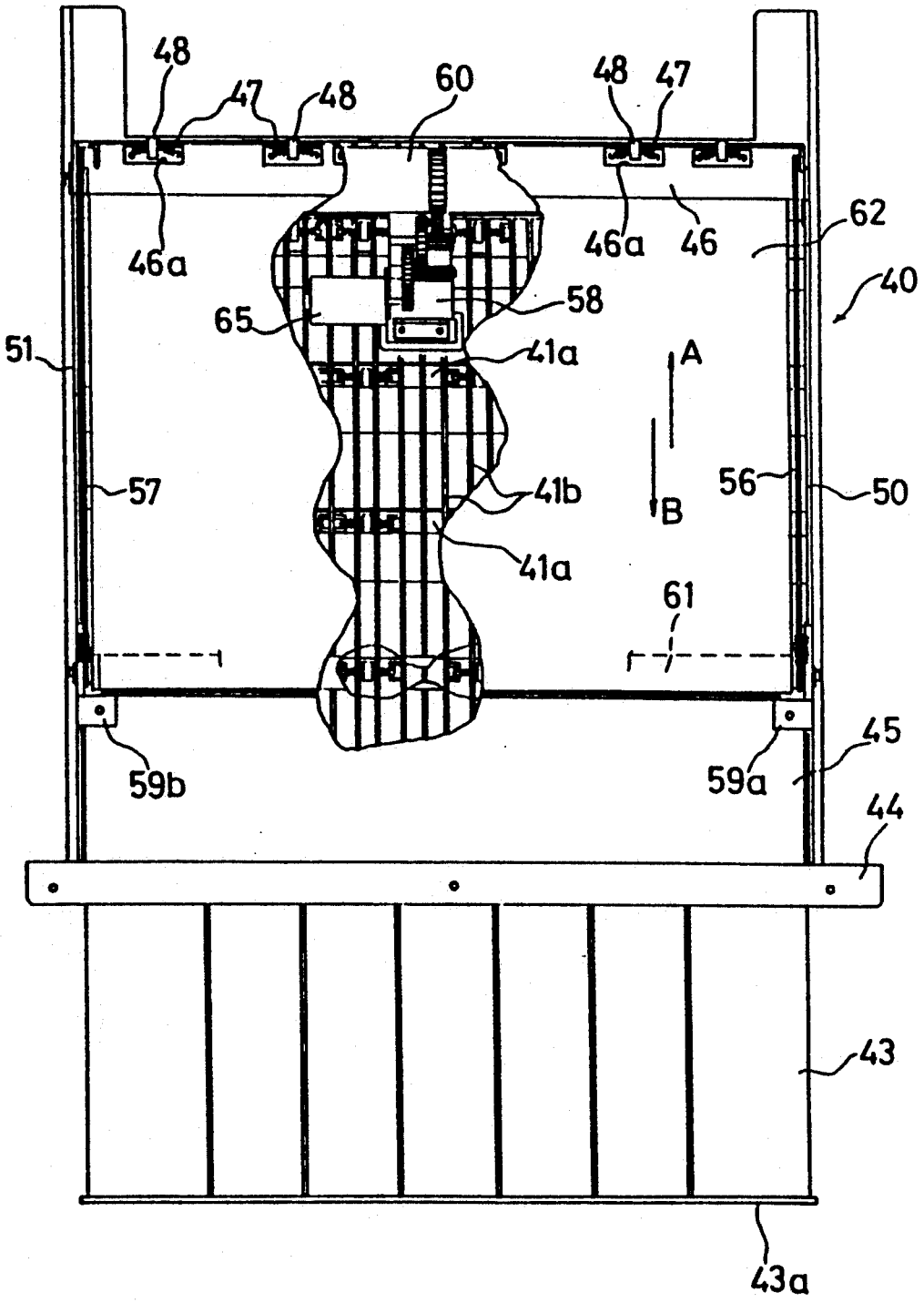
FIG. 4 is a plan view showing a discharge unit of the machine.
Figure 6:
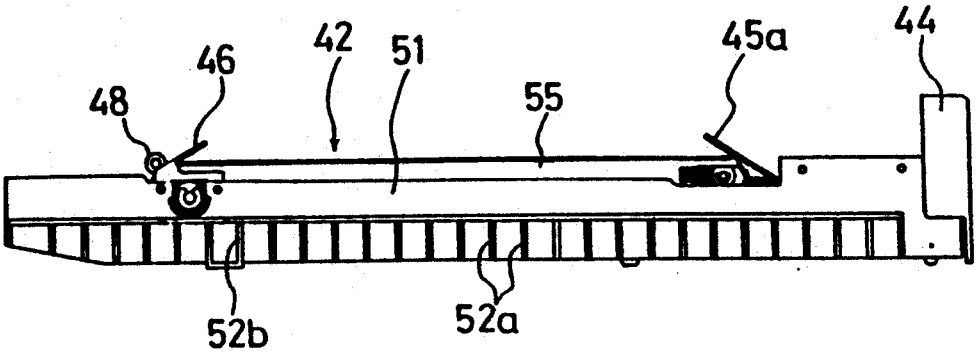
FIG. 6 is an elevational view of the discharge unit.
Figure 7:
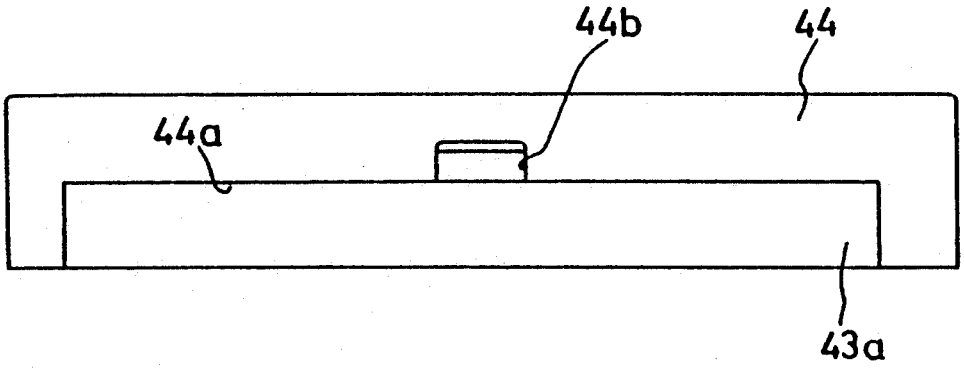
FIG. 7 is a front view of the discharge unit.

A front cover 44 is provided on the front end of the main frame 41. In the lower half of the front cover 44 is an opening 44*a* (FIG. 7) into which a stop plate 43*a* along the front face of the discharge tray 43 is receivable. Formed in the middle of the front cover 44 is a recess 44*b* which acts as a handle for extracting the discharge unit 40. This recess 44*b* also serves to allow the discharge tray 43 to be withdrawn. A front guide plate 45 is provided adjacent the front end of the main frame 41 to guide a sheet transported by the drive unit 42 toward the front side of the apparatus. A rear guide plate 46 is disposed slanting upward along the width direction of the rear end of the main frame 41, as shown in FIG. 4 and FIG. 6. The rear guide plate 46 guides sheets which are transported by the drive unit 42 toward the rear of the apparatus and, beneath the drive unit 42. The rear guide plate 46 has a plurality of cutouts 46*a* which contain coil springs 47 engaged as supports. The coil springs 47 rotatably support guide rollers 48.

The front guide plate 45 is provided with a guide member 45*a* (FIG. 6) corresponding to the rear guide plate 46, and sheets can likewise be guided toward the front and beneath by the guide member 45*a*.

As shown in FIG. 9, formed in the main frame 41 are a plurality of recesses 41*a* which extend transversely and are spaced apart from one another at a given distance along the sheet transport direction of the unit. Each of the recesses 41*a* also has, as enlargedly shown in FIG. 5, guide rollers 48 rotatably supported by coil springs 47. Also formed in the main frame 41 are a plurality of guide ribs 41*b* extending in the sheet transport direction as shown in cutaway in FIG. 4. A reflection-type optical switch (sheet discharge switch) 49, which detects that a sheet has been discharged toward the tray 43, is provided beneath the front guide plate 45.

Figure 8:
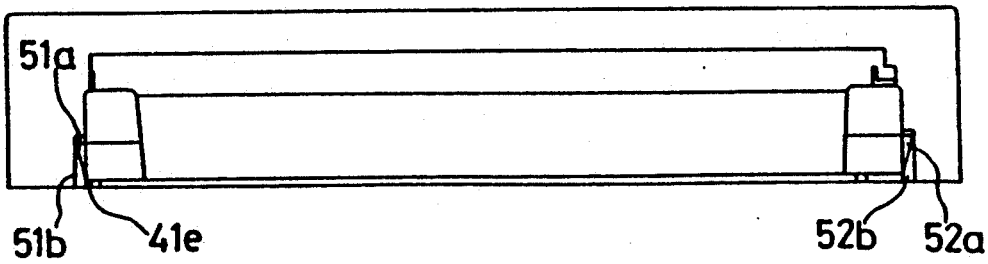
FIG. 8 is a rear view of the discharge unit.

The main frame 41 includes side walls 50 and 51 on either side. Each of the side walls 50 and 51 is provided with a plurality of reinforcement ribs 51*a* and 52*a* respectively, spaced apart from one another at a given distance, as shown in FIG. 8, in a rear view of the discharge unit 40, and in FIG. 7. The ribs 51*a* and 52*a* are downward-tapering triangles as shown in FIG. 8. Ribs 51*b* and 52*b* are formed adjacent the pivotal end of the drive unit 42 and are rectangular such that their lateral extension is essentially equidistant. The rectangular ribs 51*b* and 52*b* act as stops for the discharge unit 40, as described hereinafter.

The discharge tray 43 is slidably installed into a slot formed between a forward-lying plate 41*c* of the main frame 41 and a withdrawal guide 41*d* therebelow. A downward-projecting stop 43*b* is formed at the rear end of the discharge tray 43, which limits the extent to which it may be drawn forward by coming into abutment against the front end of the guide 41*d*.

The drive unit 42 incorporates a subframe 55 connected to the main frame 41 such that it is pivotal along its rear end. The subframe 55 includes, as shown in FIG. 4, side walls 56 and 57 each disposed parallel to respective side walls 51 and 52 of the main frame 41, a connection plate (not shown) connected between the side walls 56 and 57, and a central support plate 58 disposed centrally along the width direction in the rear. A drive roller 60 is rotatably mounted in the rear end of the subframe 55, and a driven roller 61 is rotatably mounted in the front end of the subframe 55. A circulation belt 62 is wrapped around the drive roller 60 and driven roller 61. Tabs 59*a* and 59*b* are fixed to respective sides along an edge of the front guide plate 45, wherein the ends of the tabs 59*a* and 59*b* press on the front corners of the drive unit 42.

Figure 5:
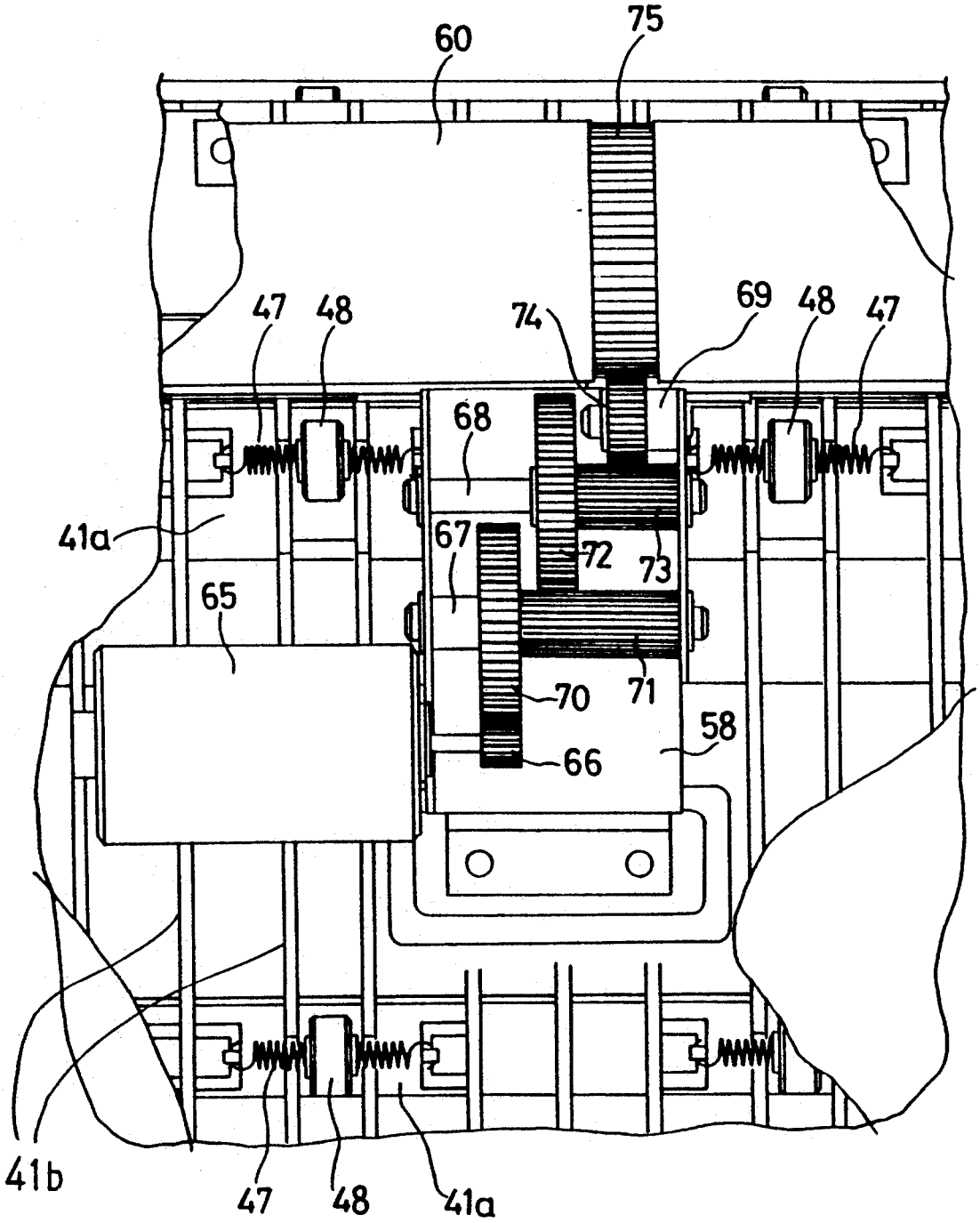
FIG. 5 is a an enlarged partial view of FIG. 4.

As shown enlargedly in FIG. 5, a drive motor 65 is fixed to the central support plate 58 of the subframe 55. A pinion 66 is fixed to the tip of the drive motor 65 motor shaft. A first shaft 67, a second shaft 68 and a third shaft 69 are rotatably mounted onto the central support plate 58. A first gear 70 and second gear 71 are fixed to the first shaft 67. A first gear 70 is engaged with the pinion 66. A third gear 72 engaged with the second gear 71, and a fourth gear 73 are fixed to the second shaft 68. A fifth gear 74 is fixed to the third shaft 69. The fifth gear 74 is engaged both with a drive roller gear 75 formed around the drive roller 60 at its widthwise middle, and with the fourth gear 73. Accordingly, rotation of the drive motor 65 is transmitted through the gear train 70, 71, 72, 73 and 74 to the gear 75 of the drive roller 60, whereby the drive roller 60 is rotated.

The positioning of the drive motor 65 centrally along the width direction of the circulation belt 62 situates the drive means such that tension on either side of the circulation belt 62 is essentially equalized as it circulates, whereby problems of belt "flutter" are averted. Furthermore, since the drive motor 65 and the gear train are covered by the circulation belt 62, a high degree of sound proofing is effected and less noise escapes outside.

Figure 10:
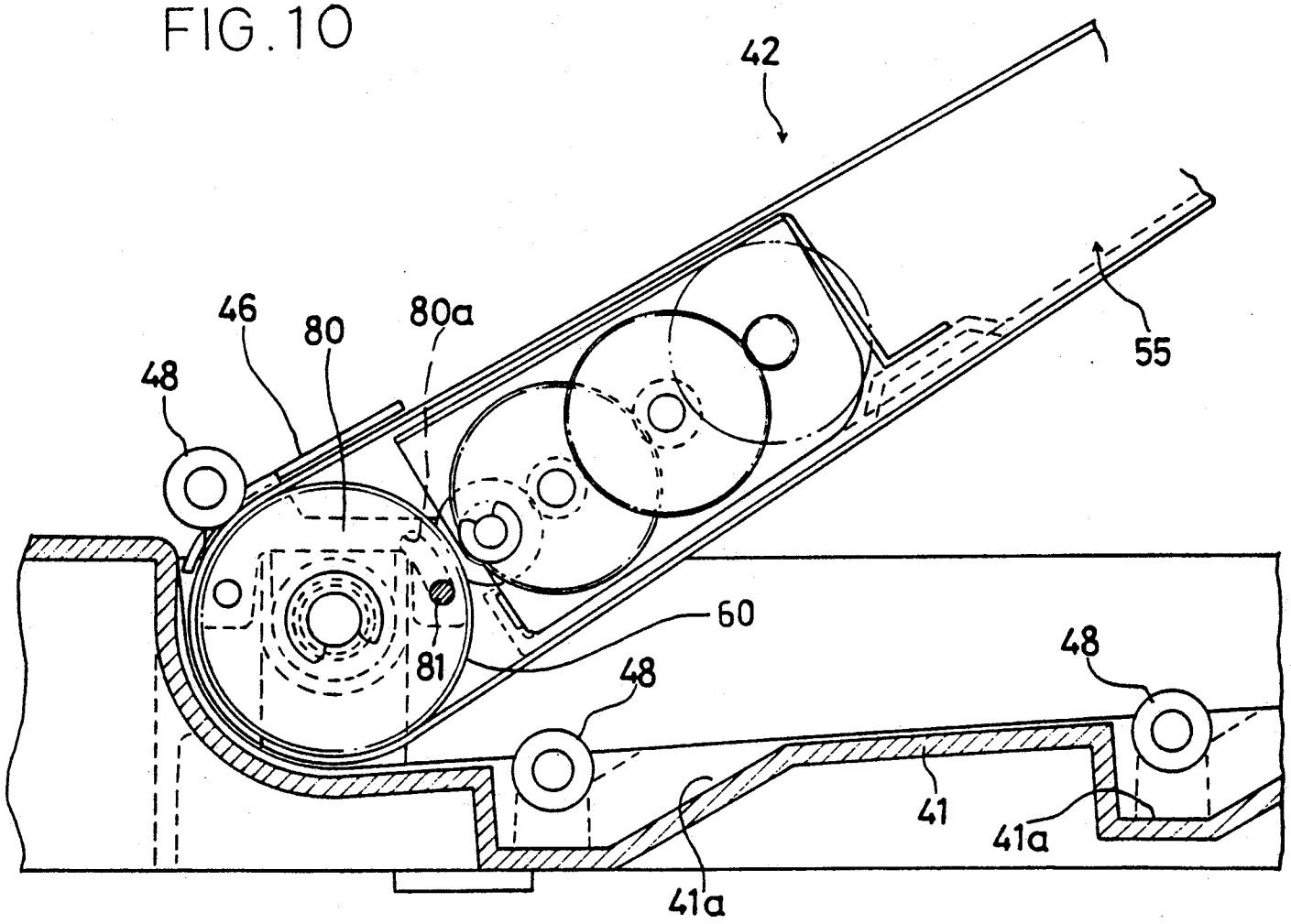
FIG. 10 is an enlarged partial view of FIG. 9.
Figure 11:
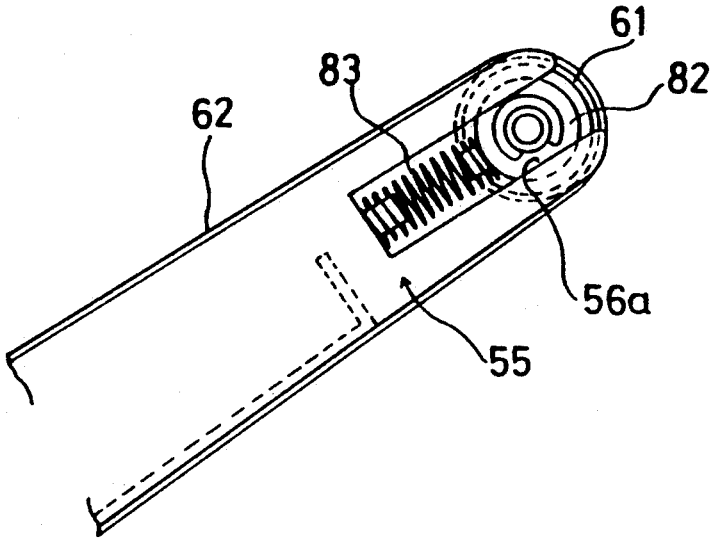
FIG. 11 is another enlarged partial view of FIG. 9.

As shown enlarged in FIG. 10, a restriction plate 80 is provided at either along the rear end of the subframe 55 for restricting the angle to which the drive unit 42 may be opened. Each restriction plate 80 is provided with an arced slot 80*a* into which a pin 81 fixed to a side wall of the main frame 41 is inserted. As shown enlargedly in FIG. 11, a support shaft 82 supporting the driven roller 61 is slidable in notches 56*a* formed in the side walls 56 and 57 of the subframe 55. Springs 83 are provided between the backs of the notches 56*a* and the ends of support shaft 82. The springs 83 urge the driven roller 61 in the direction which tensions the circulation belt 62.

As thus described in the foregoing, the discharge unit 40 is structured such that it can be easily installed into and removed from the apparatus body 1. The discharge unit 40 is also easily exchanged with a feed cassette, as will hereinafter be described.

Figure 12:
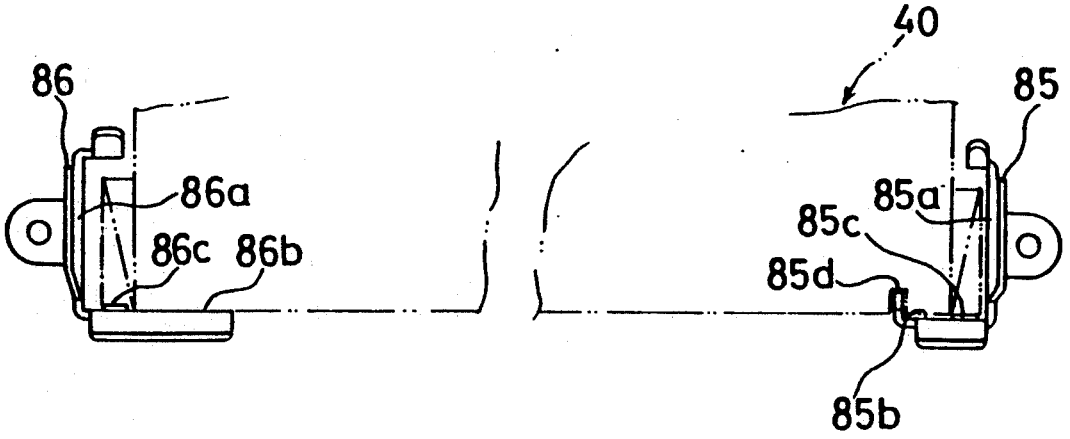
FIG. 12 is a front view illustrating guide rails of the copying machine.

The discharge unit 40 is slidable in the front-to-rear direction of the apparatus body 1, being guided in guide rails 85 and 86 of the apparatus body 1, as shown in FIG. 12. The guide rails 85 and 86 extend in the front-to-rear direction, and L-shaped in section, form respective standing walls 85*a* and 86*a*, and bottom supports 85*b* and 86*b*, which support the main frame 41 laterally underneath. Projections 85*c* and 86*c* project upward from respective front ends of the supports 85*b* and 86*b*. The projections 85*c* and 86*c* come into abutment with the lower ends of the rectangular ribs 51*b* and 52*b* formed on the main frame 41 of the discharge unit 40, whereby withdrawal of the discharge unit 40 is arrested at a certain extent. A guide rim 85*d* is formed along the edge of the support 85*b* of the guide rail 85, and is engaged with a guide groove 41*e* (FIG. 8) formed on the main frame 41 of the discharge unit 40. Their engagement prohibits transverse movement of the discharge unit 40.

Feed Cassette

Figure 13:
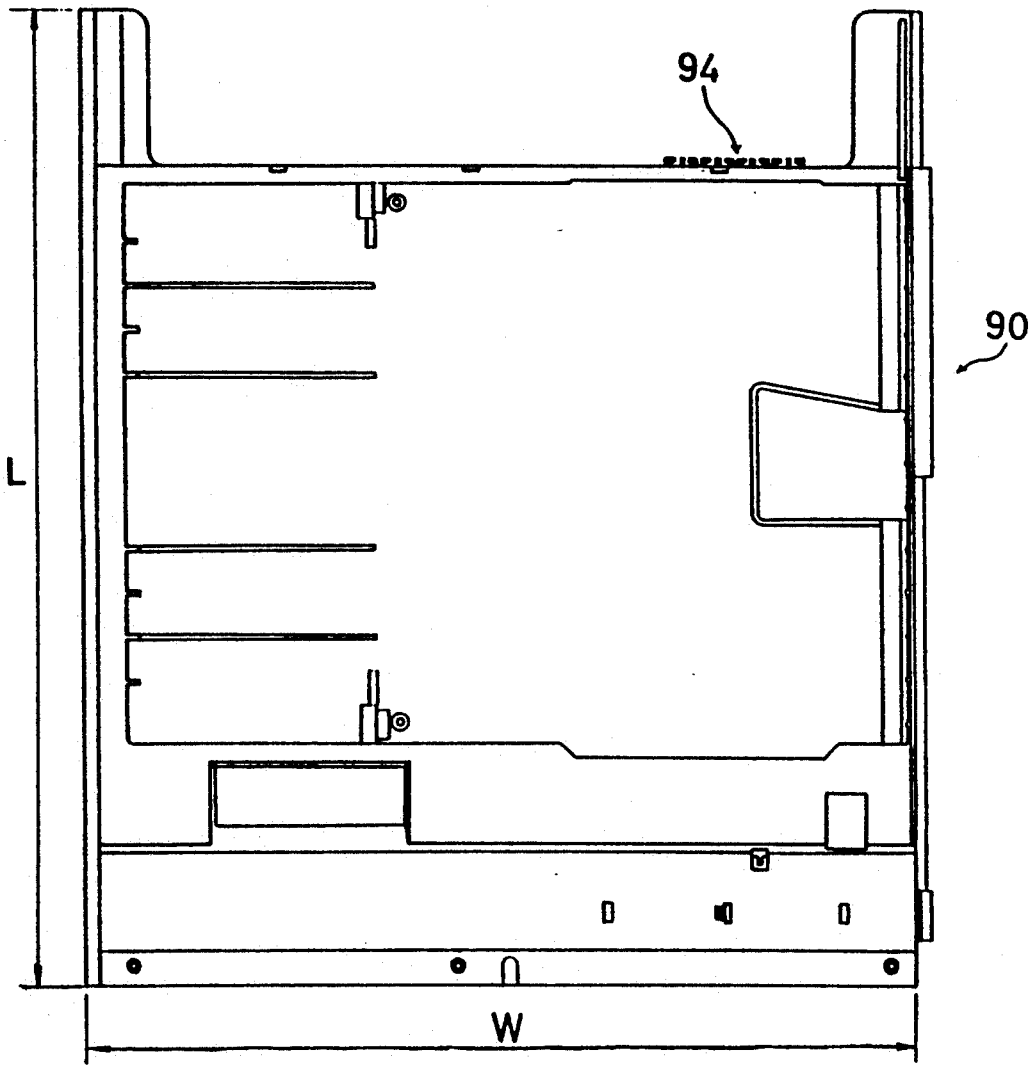
FIG. 13 is a plan view showing a feed cassette for installation into the copying machine.
Figure 14:
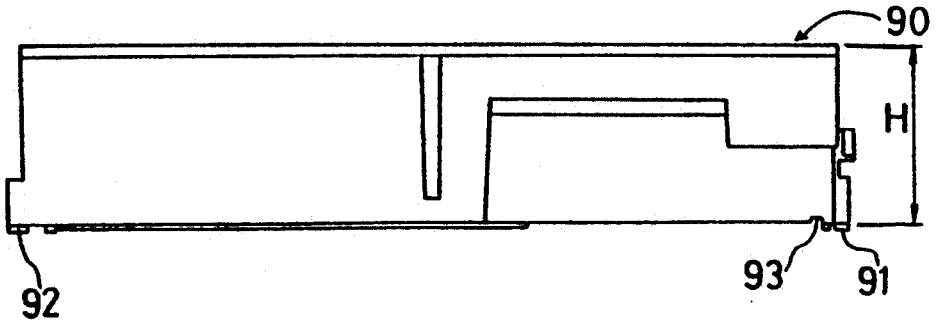
FIG. 14 is a front elevation of the feed cassette.

FIG. 13 and FIG. 14 show a feed cassette 90 insertable into the receptacle 1*c* and 1*d* of the apparatus body 1. FIG. 13 is a plan view of the feed cassette 90 and FIG. 14 is a front elevational view of the feed cassette 90. The exterior dimensions of the feed cassette 90 are the same as that of the discharge unit 40. That is, the length L in the front-to-rear direction, the width W in the transverse direction, and the height H are the same as those of the discharge unit 40. The front-to-rear extending guide rails 85 and 86 shown in FIG. 12 are fixed to the apparatus body 1 within the slot 1*d*. Provided on the feed cassette 90 are tabs 91 and 92 which come into abutment with the projections 85*c* and 86*c* of the guide rails 85 and 86, and a guide groove 93 into which the guide projection 85*d* of the guide rail 85 engages. A size detector 94 is provided on the rear wall of the feed cassette 90 for the indication of sheet size. A size reading sensor is provided on a surface of the apparatus body such that its location corresponds to that of the detector 94 of the feed cassette 90 when installed. The size reading sensor is provided so as to obtain readings from both receptacle 1*c* and 1*d*. The feed cassette 90 can be installed into either of the receptacles 1*c* and 1*d* of the apparatus body 1 since the outer dimensions of the discharge unit 40 and the feed cassette 90 are the same, so as to be compatible with the guide rails 85 and 86 of the apparatus body 1. Thus, the structural components in this copying machine are simplified and their number is reduced.

Operation Panel

Figure 15:
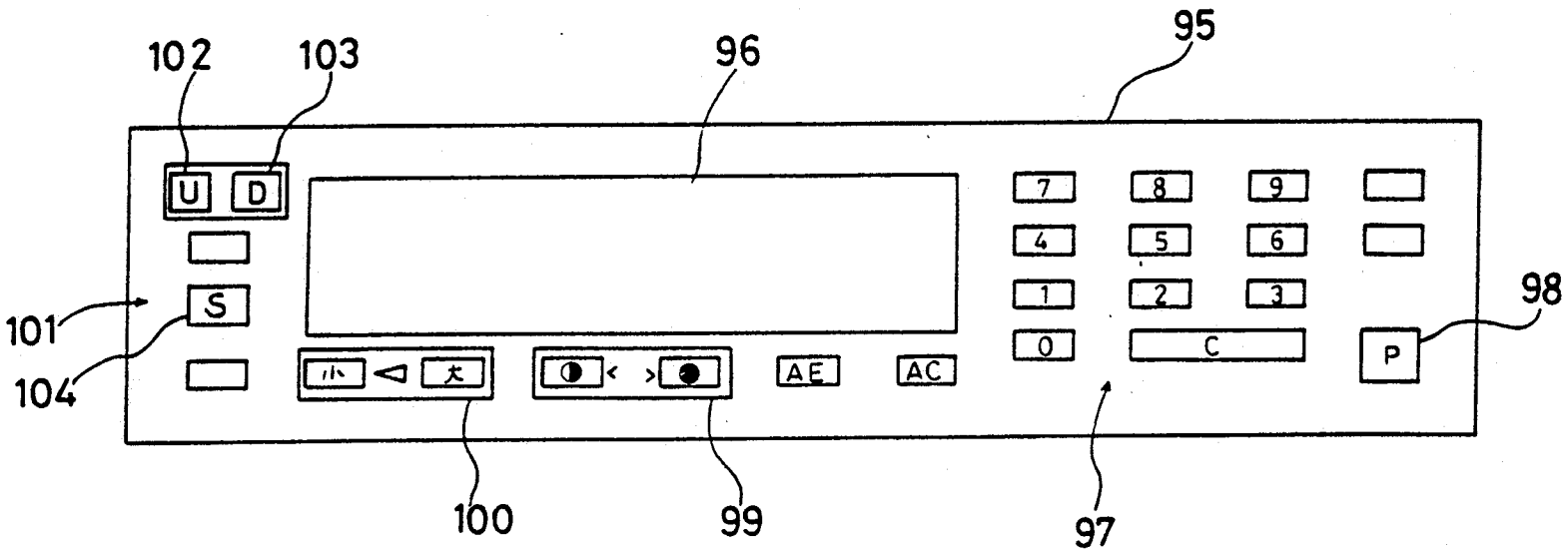
FIG. 15 depicts an operation panel of the copying machine.

Located on an upper front surface of the apparatus body 1 is, as shown in FIG. 15, an operation panel 95, wherein a liquid crystal display 96, decimal keys 97, a print key 98, a density adjustment key 99, a zoom key 100 and a key group 101 for selecting discharge modes are provided. The discharge mode selection keys 101 consist of a front discharge face-up mode instruction key 102 for instructing a copy sheet to be discharged toward the front side of the apparatus body 1 with the image-formed surface face up, a front discharge face-down mode instruction key 103 for instructing a sheet to be discharged toward the front side of the apparatus body 1 with the image-formed surface face-down, and a side-discharge mode instruction key 104 for instructing a sheet to be discharged toward the side of the apparatus body 1.

Controller

Figure 16:
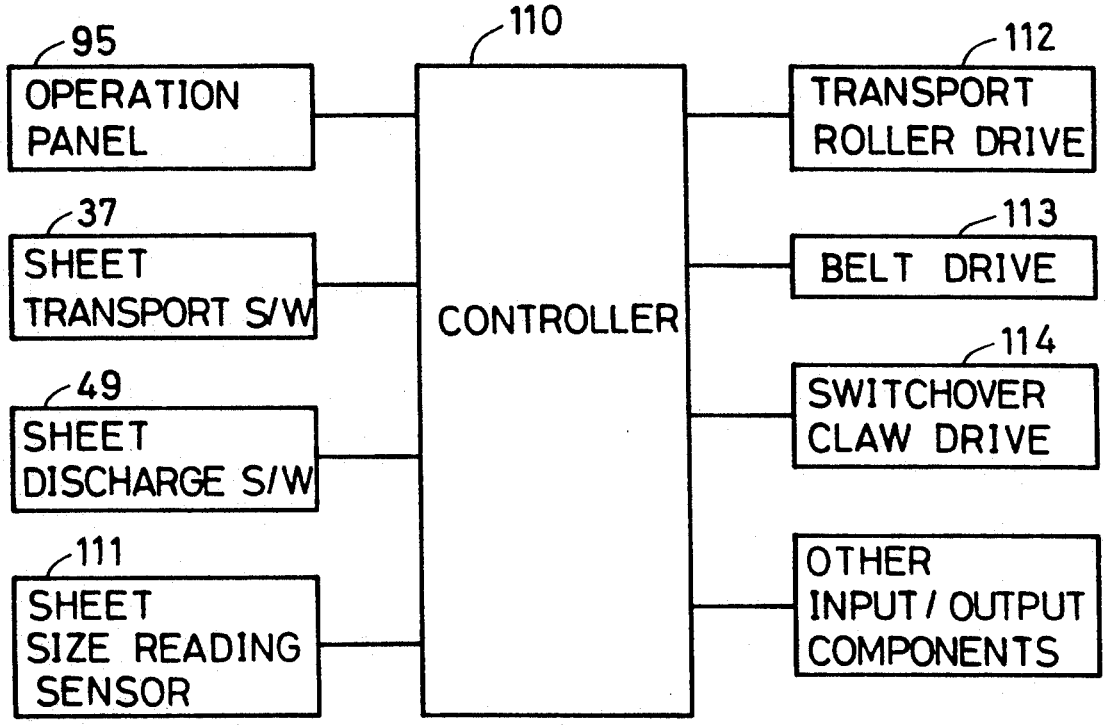
FIG. 16 is a block diagram illustrating copying machine control.

The copying machine is provided with a controller 110 as shown in FIG. 16. The controller 110 includes a microcomputer comprising, inter alia, a CPU, a RAM and a ROM. The operation panel 95 shown in FIG. 15, the sheet transport switch 37, which detects the transportation of a sheet, the sheet discharge switch 49 provided in the discharge unit 40, and the size reading sensor 111 for determining the sheet size of the feed cassette(s) 90 in installation in the receptacles 1*c* and 1*d* of the apparatus body 1, are connected with the controller 110. Wherein the size reading sensor 111 is unable to obtain a sheet size reading, it is determined that the discharge unit 40 is installed within the receptacles 1*c* and 1*d*. Further connected with the controller 110 are a transport roller drive 112 for driving the transport rollers 35 of the turned transport unit 33, a belt drive 113, including the drive motor 65, for driving the circulation belt 62, a switchover claw drive 114 which drives a solenoid for shifting the position of the switchover claw 36, as well as other input/output components.

Application and General Operation

Next, application and general operation of the copying machine according to the present invention will be explained.

Initially, when the main switch is pressed, the front discharge face-up mode is automatically selected as a discharge mode. Usually, the discharge unit 40 is installed into the upper receptacle 1*c* and the feed cassette 90 is installed into the lower slot 1*d*. The discharge tray 43 is drawn forward from the discharge unit 40 in a front discharge mode. The discharge tray 43 is storable into the apparatus body 1 when not copying, clearing the path in front of the apparatus and widening the working space.

When the print key 98 is pressed, a sheet is fed from the feed cassette 90 to the feed transport path 17 by the sheet feed unit 15, and sent to the image forming section through the resist rollers 24. An image-formed sheet is then transported to the fixing unit 30 by the discharge transport unit 25. After image fixation, the sheet is guided by the switchover claw 36 toward the turned transport unit 33 and fed now rolled over onto the circulation belt 62 of the discharge unit 40 in an aquiring plane. The circulation belt 62 then begins to circulate, its upper surface moving rearward. As a result, the sheet on the circulation belt 62 is transported backward, pitched over through the rear portion and transported forward in a plane substantially parallel to said aquiring plane. The sheet is thus discharged onto the discharge tray 43 in the front side of the apparatus face-up.

In order to discharge the sheets to the front side of the body face-down, the face-down mode instruction key 103 is pressed, setting the discharge mode accordingly. After the sheet is fed onto the circulation belt 62 as above, the circulation belt 62 starts to rotate in the direction reverse to that as above. The sheet is discharged onto the discharge tray 43 in the face-down state in which it was fed onto the circulation belt 62.

If the side discharge mode instruction key 104 is pressed the sheet can be discharged sideways to the tray 32 attached to the side of the apparatus body 1. In this instance, the discharge tray 43 of the discharge unit 40 is stored into the apparatus body 1 because it is unnecessary. A copy sheet after undergoing image fixation is discharged out onto the discharge tray 32 through the side discharge transport path 31.

Another feed cassette can be installed into be upper receptacle 1c in lieu of the discharge unit 40, wherein the side discharge mode is automatically set as the discharge mode. If the upper feed cassette is selected, sheets are supplied to the image forming section through the sheet transport paths 22 and 23.

Thus according to the foregoing, various discharge modes corresponding to use conditions are selectable in this copying machine. Furthermore, wherein the discharge unit 40 is not installed, the side discharge mode is automatically selected, whereby sheet-jamming within the apparatus body 1 due to failure to set the discharge mode is averted. Since the discharge unit 40 is installable above the feed cassette, and the sheets are discharged to a position nearest the operator (in an uppermost part), it is easy to check the copy quality.

Process Control

Figure 17:
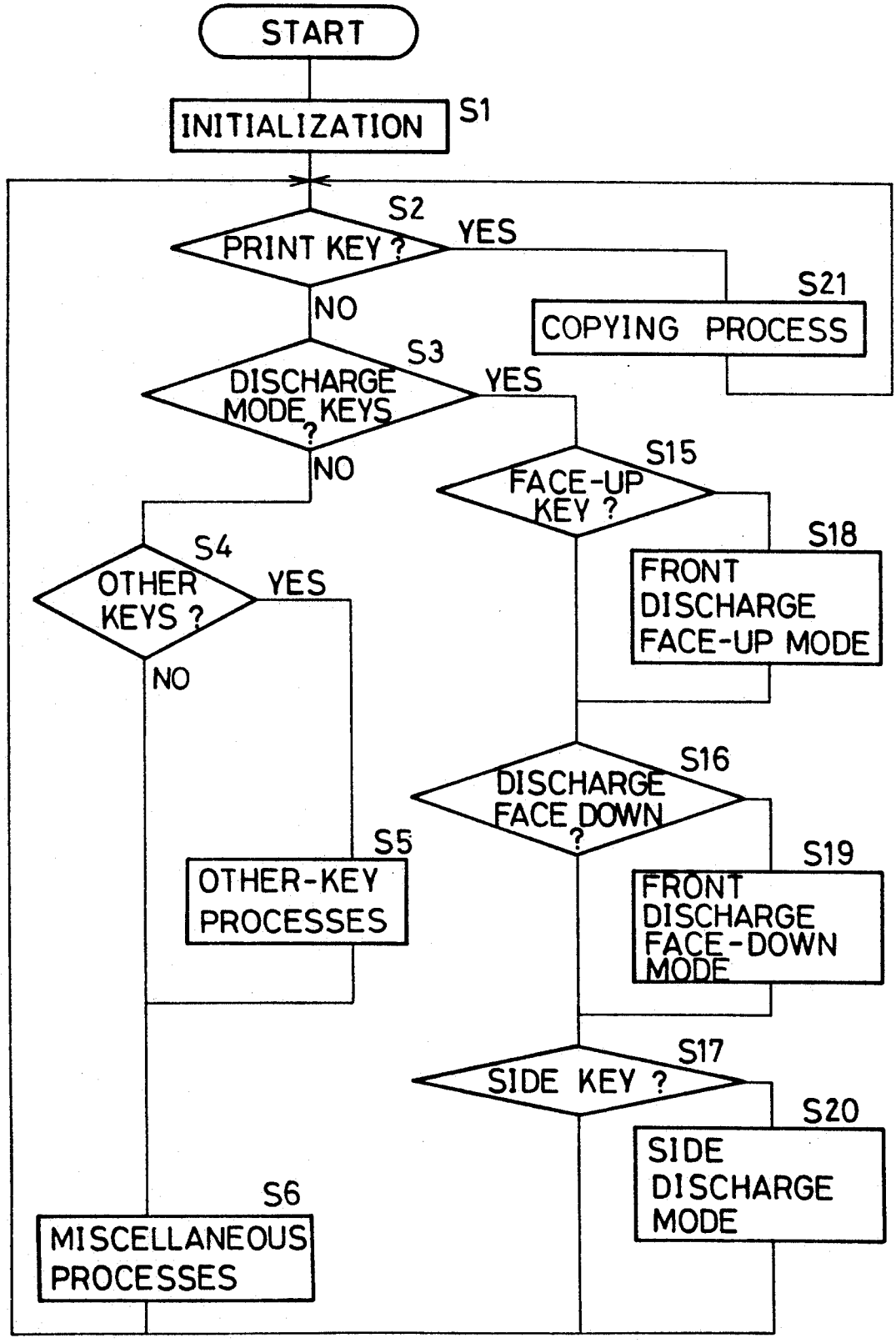
FIG. 17 is a process flow chart of the copying machine control.

Referring now to the flow chart of FIG. 17, machine process control will be explained.

When the main switch (not shown) is turned on initialization is carried out at step S1, wherein among the execution of other processes the copy number is set to one. At step S2, it is determined whether or not the print key 98 has been pressed. At steps S3 and S4, it is determined whether a key of the discharge mode selection key group 101 has been pressed, and whether other keys have been pressed, respectively. If other keys have been pressed, the program proceeds from step S4 to step S5, wherein it executes the according process or processes in response to the key pressed. At step S6, the program executes miscellaneous processes and returns to step S2.

Figure 18:
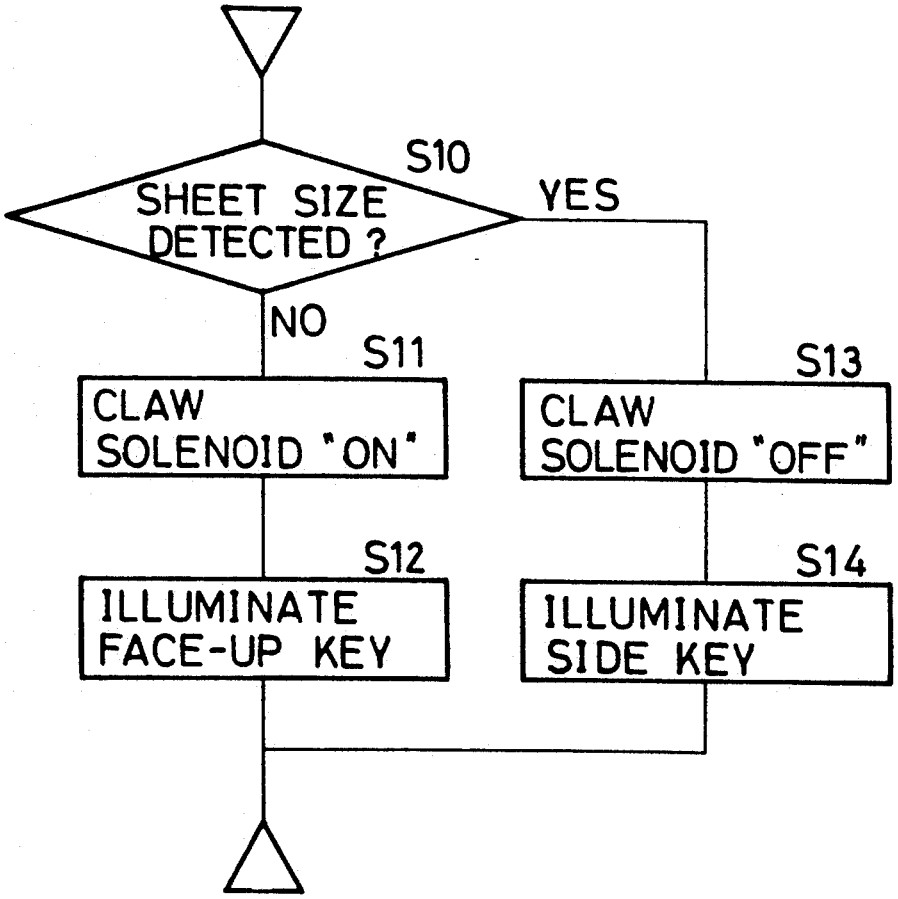
FIG. 18 is a flow chart of a display and control process in a discharge mode.

During the initialization at step S1, display of the discharge mode, and the process control represented by FIG. 18 are carried out. At step S10, it is determined whether or not the sheet-size reading sensor 111 is making a sheet size detection. If the discharge unit 40 is installed into the upper receptacle 1c of the apparatus body 1, the detection is not made therein, whereupon the program proceeds from step S10 to step S11. At step S11, the solenoid is activated to drive the switchover claw 36. As a result, the switchover claw 36 assumes the front-discharge position as shown in FIG. 3 such that a copy sheet transported from the fixing unit 30 is guided toward the turned transport unit 33. Then, at step S12, the front discharge face-up key (U key) on the operation panel 95 is illuminated.

Meanwhile, if the discharge unit 40 is not installed into the apparatus body 1 (for example, wherein a feed cassette is installed into the receptacle 1c), the program proceeds from step S10 to step S13. At step S13, the solenoid is deactivated, whereby the switchover claw 36 assumes the side discharge position as shown in FIG. 2. At step S14, the side discharge mode key 104 on the operation panel 95 is illuminated.

As thus described above, the sheet discharge paths initially are automatically switched over according to the state of installation of the discharge unit 40. If it is installed, the front discharge face-up discharge mode is automatically selected. If the discharge unit 40 is not installed, the side discharge mode is automatically selected.

It is possible for an operator to manually select the discharge mode by pressing appropriate selection keys on the operation panel 95. Specifically, if a discharge mode selection key is pressed, the program proceeds from step S3 of FIG. 17 to step S15. At step S15, it is determined whether or not the front discharge face-up mode key (U key) 102 has been pressed. At step S16, it is determined whether or not the front discharge face-down mode key (D key) 103 has been pressed. At step S17, it is determined whether or not the side discharge mode key (S key) 104 has been pressed. If the U key 102 has been pressed, the program proceeds from step S15 to step S18, wherein the front discharge face-up mode is selected. In this mode, the solenoid is activated, compelling the switchover claw 34 to assume the front discharge position. If the D key 103 has been pressed, the program proceeds from step S16 to step S19. At step S19, the front discharge face-down mode is selected as the discharge mode. In this mode, the switchover claw also assumes the front discharge position. If the S key 104 has been pressed, the program proceeds from step S17 to step S20. At step S20, the side discharge mode is selected as the discharge mode, wherein the switchover claw 36 is made to assume the side discharge position.

If the print key 98 has been pressed, the program proceeds from step S2 to step S21, wherein a copying process is carried out including sheet-feeding, image-forming and discharge stages. Following the copying process, the program returns to step S2.

Figure 19:
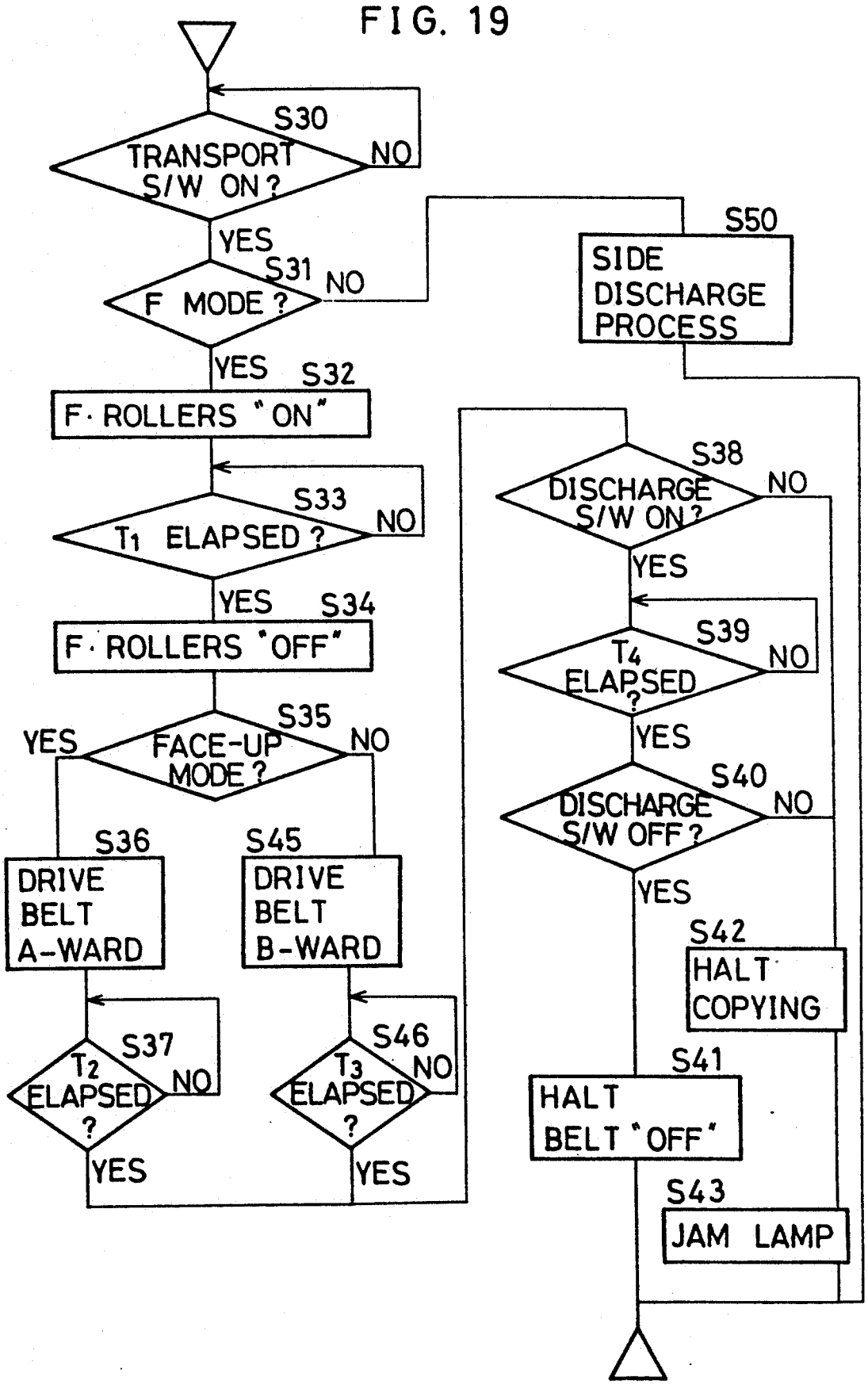
FIG. 19 is a control process flow chart of a discharge operation.

Following is a description of the discharge stage of the copying process at step S21 made with reference to the flow chart of FIG. 19.

At step S30, it is determined whether or not the sheet transport switch 37 disposed downstream of the fixing unit 30 is on. In response to the switching on of the transport switch 37, the program proceeds from step S30 to step S31. At step S31, it is determined whether or not the discharge mode is the front discharge mode. If the front discharge mode has been selected, the program proceeds from step S31 to step S32. At step S32, the transport rollers 35 of the turned transport unit 33 are driven. A copy sheet passed through the fixing unit 30 is guided to the transport path 34 of the turned transport unit 33 by the switchover claw 36, and therein is rolled over, and guided onto the discharge unit 40 below the fixing unit 30 by the transport rollers 35. At step S33, it is determined whether or not a time $T_1$ has elapsed after switch-on of the transport switch 37. The time $T_1$ is determined according to the sheet size and its elapse indicates that a sheet has been fully set onto the circulation belt 62 of the discharge unit 40. After the elapse of time $T_1$, it is determined that the current sheet has been delivered onto the circulation belt 62, and the program proceeds from step S33 to step S34. At step S34, the transport rollers 35 of the turned transport path 33 are halted.

At step S35, it is determined whether or not the face-up mode of the front discharge modes has been selected. If so, the program proceeds from step S35 to step S36. At step S36, the drive motor 65 is driven in its routine direction, its rotation is transmitted to the gear 75 of the drive roller 60 through the pinion 66 and the first to fifth gears 70 to 74, and the drive roller 60 is thereby rotated. When the drive roller 60 rotates, the circulation belt 62 wrapped around the drive roller 60 rotates in the "A" direction of FIG. 4. The copy sheet set onto the circulation belt 62 is then transported rearward along it. The sheet is guided beneath the circulation belt 62 by the rear guide plate 46 and subsequently is guided forward further by the circulation belt 62 and by the transport rollers 48. Thus, the sheet as set onto the circulation belt 62 is discharged onto the discharge tray 43 face-up.

At step S37, it is determined whether or not a time $T_2$ has elapsed after start of rotation of the circulation belt 62. Following the elapse of time $T_2$, the program proceeds to step S38, wherein it is determined whether or not the sheet discharge switch 49 located under the front guide plate 45 detecting that a sheet has been discharged is on. If the sheet discharge switch 49 is on, the program proceeds to step S39, wherein it is determined whether or not a time $T_4$ has elapsed since switch-on of the discharge switch 49. The time $T_4$ is determined according to the sheet size and its elapse indicates that a sheet has been fully discharged from the discharge unit 4. Following the elapse of time $T_4$, the program proceeds to step S40. At step S40, it is determined whether or not the discharge switch 49 is off. If the copy sheet has been discharged normally from the discharge unit 40, the discharge switch 49 is switched off after the elapse of time $T_4$ and then the program proceeds from step S40 to step S41. At step S41, the circulation belt 62 is halted by discontinuing the rotation of the drive motor 65.

At step S38, if the discharge switch 49 has not gone on despite the elapse of time $T_2$, there is a possibility that a sheet has become jammed around the rear portion of the discharge unit 40. If the discharge switch 49 has not switched off after the elapse of time $T_4$ at step S40, a sheet may have become jammed around the front portion of the discharge unit 40. In those instances, the program proceeds to step S42 and the copying operation is halted. Then at step S43, a jam display lamp on the operation panel 95 is illuminated, wherein the control processes are terminated.

If sheets become jammed in the discharge unit 40, it is necessary to draw the discharge unit 40 forward by pulling recess handle **44*b* of the front cover 44, and therein the discharge unit 40 is smoothly withdrawn along the guide rails 85 and 86 fixed to the apparatus body 1. The rectangular ribs 51*b* and 52*b* come into abutment with the projections 85*c* and 86*c* of the guide rails as the rear portion of the circulation belt 62 has gone out the apparatus body 1, whereby withdrawal of the discharge unit 40 is checked. In this state, the tabs 59*a* and 59*b* of the discharge unit 40 are removed so that the front part of the drive unit 42 may be lifted up to assume the state shown in FIG. 9. Accordingly, sheets jammed in the rear portion and front portion of the discharge unit 40** may be easily removed.

According to the foregoing, when the front discharge face-up mode is selected, a sheet on which an image has been fixed is rolled over by the turned transport unit 33 and fed onto the circulation belt 62 face-down. The circulation belt 62 is then circulated in the A direction, pitching over the sheet and discharging it face-up onto the discharge tray 43 in the front side of the apparatus body 1. As a result, an operator is able to easily check the copy quality during a copying operation, ensuring that faulty copies are kept to a minimum.

Meanwhile, when the front discharge face-down mode is selected as the discharge mode, at step S35 of FIG. 19, it is determined that the answer is NO, and the program proceeds from step S35 to step S45. At step 45, the drive motor is driven in the direction reverse to that previously described. The drive roller 60 is rotated reversely by means of the pinion 66 and the first to fifth gears 70 to 74, driving the circulation belt 62 in the "B" direction. Subsequetly, a sheet having been placed onto the circulation belt 62 is discharged forward of the apparatus body 1 face-down. At step S46, it is determined whether or not a time $T_3$ has elapsed after the circulation belt 62 has begun circulating. Time $T_3$ is shorter than time $T_2$ and is also determined according to sheet size. At step S46, if it is determined that time $T_3$ has elapsed, the program proceeds from step S46 to step S38. The processes at step S38 are the same as those in the face-up mode.

When the side discharge mode is selected as the discharge mode, at step S31 of FIG. 19, it is determined that the answer is NO, and the program proceeds from step S31 to step S50. At step S50, the side discharge process is carried out. A sheet having passed through the fixing unit 30 is guided toward the left side of the apparatus body 1 by the side discharge transport path 31 and the switchover claw 36, and then discharged onto the discharge tray 32.

Another Embodiment

Figure 20:
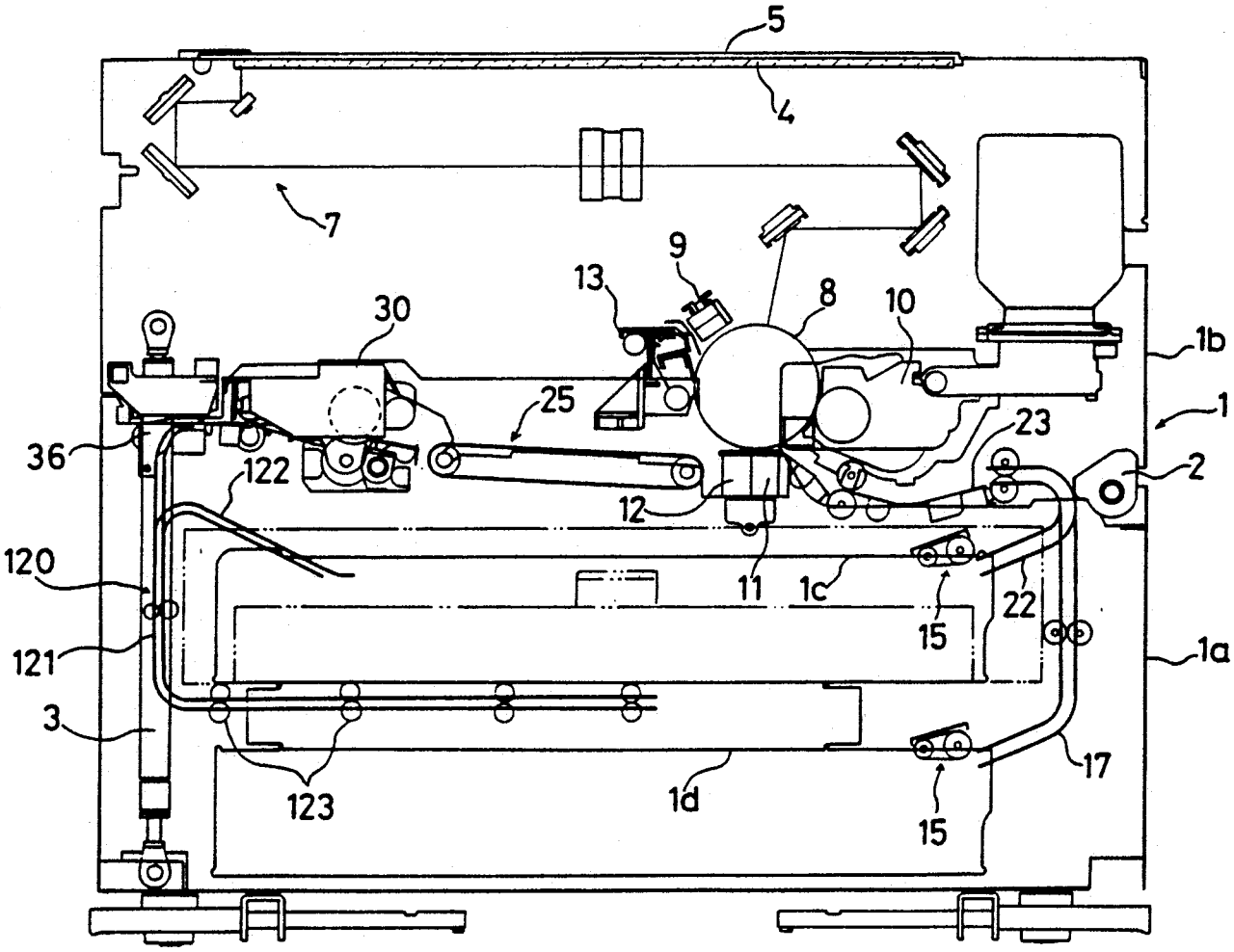
FIG. 20 is a schematic elevational view showing a copying machine according to another embodiment of the present invention.
Figure 21:
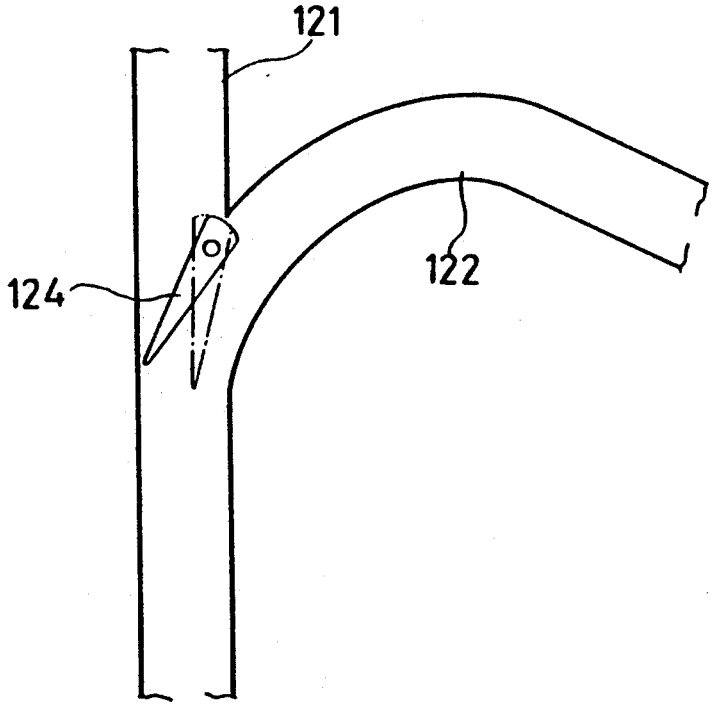
FIG. 21 is an enlarged partial view of FIG. 20.

In a further embodiment as shwon in FIG. 20, an overturn unit 120 for reversing copy sheets is provided midway along the path guiding sheets passed through the fixing unit 30 toward the discharge unit 40. The overturn unit 120 consists of a first transport path 121 which extends downward from the switchover claw 36 and turns to extend along the underside of the receptacle **1*c* for the discharge unit 40 substantially parallel to it; a second transport path 122 branched off of the middle of the first transport path 121 for guiding a sheet transported from beneath the discharge unit 40 back toward it; and transport rollers 123 for sheet transport along the transport paths 121 and 122. Another switchover claw 124 is located at a junction between the first transport path 121 and the second transport path 122, as shown in FIG. 21. The switchover claw 124 in selection assumes either the position shown by dashed lines, for guiding a sheet in the first transport path 121 downward, or that shown by solid lines, for guiding a sheet, transported upward, into the second transport path 122**. The remaining structures of this embodiment are the same as those of the first embodiment.

When the front discharge mode is selected, a sheet having passed through the fixing unit 30 is guided toward the first transport path 121 by the switchover claw 36. Therein, the switchover claw 124 is controlled to assume the dashed-line position of FIG. 21. Accordingly, a sheet having entered the first transport path 121 is sent beneath the discharge unit 40, in which part of transport path 121 it is face-down.

With the sheet now transported into the horizontal section of the first transport path 121, the transport rollers 123 start to rotate in reverse. The sheet is then reverse-transported back through the first transport path 121, upward. At this time, the switchover claw 124 is controlled to assume the solid-line position of FIG. 21. As a result, the sheet transported upward through the first transport path 121 is guided by the switchover claw 124 into the second transport path 122 and then is transported therethrough onto the circulation belt 62 of the discharge unit 40. The sheet is thus placed onto the circulation belt 62, in this case face-up.

When the front discharge face-up mode is selected as the discharge mode, the circulation belt 62 is circulated in direction B of FIG. 4, unlike in the first embodiment. The sheet is discharged face-up onto the discharge tray 43 in the front side of the apparatus body 1. When the front discharge face-down mode is selected, the circulation belt 62 is circulated in direction A of FIG. 4. The sheet is pitched over, to be discharged face-down onto the discharge tray 43 in the front side of the apparatus body 1.

In the aforedescribed embodiments, the present invention is applied to copying machines, but it is possible to apply the present invention to the discharge units of other printing machines and image forming apparatus as well.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A discharge system of an image forming apparatus for discharging out of a body of said image forming apparatus a sheet on which an image has been formed in an image forming section thereof, comprising;

means for transporting said image-bearing sheet in a transverse direction of the image forming apparatus, discharge means for acquiring the sheet transported by said transport means in an acquiring plane, and for transporting the acquired sheet in a plane substantially parallel with said acquiring plane and in a direction substantially perpendicular to said transverse direction, toward a user-directed side of the image forming apparatus, in order to discharge the sheet out of the apparatus body.

2. A discharge system according to claim 1, wherein said transport means includes a discharge transport unit extending in said transverse direction of the image forming apparatus, and said discharge means is located below said discharge transport unit;

said discharge system further comprising a turned transport means for transporting a sheet transported by said transport means to said discharge means, wherein said discharge means is for receiving thereon the sheet transported by said turned transport means, and for discharging the sheet out of the apparatus body.

3. A discharge system according to claim 2, wherein said turned transport means in transporting the sheet from said transport means to said discharge means overturns the sheet, said discharge means in discharging a sheet received from said turned transport means pitches the sheet over.

4. A discharge system according to claim 3, wherein said discharge means includes a circulatory transport belt which, circulating in a direction substantially normal to said transverse direction of the image forming apparatus, transports a sheet received onto said discharge means away from said user-directed side, turns the sheet under said discharge means and reverses said transport of the sheet, and further discharges the sheet toward said user-directed side.

5. A discharge system according to claim 4, wherein said discharge means includes a guide plate for guiding the sheet received onto said circulatory transport belt as said sheet is transported away from said user-directed side and downward of said discharge means.

6. A discharge system according to claim 3, further including sheet-receiving means for receiving a sheet discharged by said discharge means, wherein said sheet-receiving means is extractable from said image forming apparatus.

7. A discharge system according to claim 2, wherein said turned transport means includes a guide curved downward from an end of said discharge transport unit, and a plurality of transport rollers for transporting a sheet guided by said guide.

8. A discharge system according to claim 7, further comprising:

a side discharge transport path located adjacent an end of said transport means, for discharging a sheet in the transverse direction of the image forming apparatus, and a switchover claw located between said side discharge path and said guide, which through a selection assumes either a first discharge position which directs a sheet from said transport means to said side discharge transport path, or a second discharge position which directs the sheet to said guide.

9. A discharge system according to claim 8, wherein said transport means includes a circulatory transport belt forming said discharge transport unit, and a drive roller and a driven roller around which said circulatory transport belt wraps.

10. A discharge system according to claim 2, wherein said discharge means comprises means for circulatory transport in the direction substantially normal to said transverse direction of the image forming apparatus in order to discharge a sheet toward said user-directed side of the image forming apparatus, and means for driving said circulatory transport means.

11. A discharge system according to claim 10, further comprising means for detecting whether or not a sheet is received onto said circulatory transport means, and means for controlling said drive means according to a determination of said sheet-receive detection means.

12. A discharge system according to claim 11, further comprising means for detecting whether or not a sheet is discharged out of said circulatory transport means, and means for determining whether or not a sheet is jammed along said circulatory transport means according to a determination of said sheet-discharge detection means.

13. A discharge system according to claim 12, further comprising means for controlling said drive means according to a determination of said sheet-discharge detection means.

14. A discharge system according to claim 10, wherein said discharge means further comprises a frame for detachable installation into said image forming apparatus body, and said circulatory transport means and said drive means are supported by said frame.

15. A discharge system according to claim 14, wherein said frame comprises a pivotal subframe, and said circulatory transport means and said drive means are attached to said subframe.

16. A discharge system according to claim 15, further comprising means located at an end of said subframe on which it is pivotal for restricting a pivoting range of said subframe.

17. A discharge system according to claim 16, wherein said pivoting range restriction means comprises an arced slot formed in said subframe and a pin fixed onto said unit frame and inserted into said slot.

18. A discharge system according to claim 15, wherein said circulatory transport means comprises a drive roller rotatably mounted in an end of said subframe, a driven roller rotatably mounted in an end of said subframe opposite said end on which said drive roller is mounted, and a circulatory transport belt wrapped around both of said drive and driven rollers; and said drive means comprises a motor and a device for transmitting power of said motor to said drive roller.

19. A discharge system according to claim 18, wherein said motor and said transmission device are connected with said drive roller along its axially middle portion.

20. A discharge system according to claim 19, wherein said motor and said transmission device are so disposed as to be enveloped by said circulatory transport belt.

21. A discharge system according to claim 20, wherein said driven roller is slidable in a linear circulation direction of said circulatory transport belt;

further comprising means for urging said driven roller in a direction in which said circulatory transport belt is tensioned.

22. A discharge system according to claim 2, wherein said turned transport means in transporting a sheet sent from said transport means to said discharge means overturns the sheet; and said discharge means is able to circulate in either of two opposing directions substantially normal to said transverse direction of said image forming apparatus, providing selectable circulation modes wherein in one circulation mode, a sheet which has been transported by said return transport means is received onto said discharge means and is overturned and transported toward the user-directed side of said image forming apparatus body, and in another circulation mode, the received sheet is transported toward the user-directed side of said image forming apparatus without being overturned;

said discharge system further comprising means for controlling a discharge operation of said discharge means.

23. A discharge system according to claim 22, wherein said discharge means comprises:

circulatory transport means for acquiring a sheet and for circulating in the direction substantially normal to said transverse direction of the image forming apparatus in order to discharge the sheet toward the user-directed side of the image forming apparatus, and means for driving said circulatory transport means.

24. A discharge system according to claim 23, wherein said discharge means further comprises a frame which is detachably installable into said image forming apparatus body, and said circulatory transport means and said drive means are supported by said frame.

25. A discharge system according to claim 24, wherein said frame comprises a pivotal subframe, and said circulatory transport means and said drive means are attached to said subframe.

26. A discharge system according to claim 25, wherein said circulatory transport means comprises a drive roller rotatably mounted in one end of said subframe, a driven roller rotatably mounted in an end of said subframe opposite said end on which said drive roller is mounted, and a circulatory transport belt wrapped around both of said drive and driven rollers;

said drive means comprises a motor and a device for transmitting power of said motor to said drive roller.

27. A discharge system according to claim 26, wherein said motor and said transmission device are connected with said drive roller along its axially middle portion.

28. A discharge system according to claim 27, wherein said motor and said transmission device are so disposed as to be enveloped by said circulatory transport belt.

29. A discharge system according to claim 28, wherein said driven roller is slidable in a linear circulation direction of said circulatory transport belt;

further comprising means for urging said driven roller in a direction in which said circulatory transport belt is tensioned.

30. A discharge system according to claim 22, further comprising means for receiving a sheet discharged by said discharge means.

31. A discharge system according to claim 30, wherein said sheet-receiving means is extractable from said image forming apparatus.

32. A discharge system according to claim 2, further comprising means for transporting a sheet transported from said transport means to beneath said transport means, wherein the image-bearing surface of the sheet is face-up.

33. A discharge system according to claim 32, wherein said discharge means comprises circulatory transport means for acquiring a sheet and for circulating in a direction substantially normal to said transverse direction of the image forming apparatus in order to discharge a sheet toward the user-directed side of the image forming apparatus, and means for driving said circulatory transport means.

34. A discharge system according to claim 33, further comprising means for receiving a sheet discharged by said discharge means.

35. A discharge system according to claim 34, wherein said sheet-receiving means is extractable from said image forming apparatus.

36. A discharge system according to claim 1, further including sheet-receiving means for receiving a sheet discharged by said discharge means, wherein said sheet-receiving means is extractable from said image forming apparatus.

37. A discharge system according to claim 36, wherein said front discharge means further comprises a frame which is detachably installable into said image forming apparatus body, and said sheet-receiving means is extractably mounted into said frame.

38. A discharge system according to claim 37, wherein a front cover having an opening is provided on the user-directed side of said frame, said sheet-receiving means is a tray having a stop at its front end, which stop is containable into said opening.

39. An image forming apparatus comprising;

an image forming section capable of forming an image onto a sheet, at least one feed cassette located below said image forming section movable in a front-to-rear direction of the apparatus for containing sheets for supply to said image forming section, feed transport means for transporting a sheet from said feed cassette to said image forming section, discharge transport means for transporting an image-bearing sheet from said image forming section to beneath said image forming section, and a discharge part located above an uppermost feed cassette for receiving a sheet from said discharge transport means, wherein said discharge transport means includes a transport path for transporting said image-bearing sheet in a transverse direction of the image forming apparatus, and said discharge part includes a front discharge unit which acquires a sheet from said discharge transport means in an acquiring plane and transports the sheet in a plane substantially parallel to said acquiring plane and in a direction substantially perpendicular to said transverse direction, toward a user-directed side of the image forming apparatus, in order to discharge the sheet out of the apparatus, and means for receiving a sheet discharged by said front discharge unit.

40. An apparatus according to claim 39, wherein said front discharge unit comprises a circulatory transport belt which circulates in said front-to-rear direction of the image forming apparatus in order to discharge a sheet toward said front side, and further comprises means for driving said circulatory transport belt.

41. An apparatus according to claim 40, wherein said discharge part includes means extractable from said image forming apparatus.

42. An image forming apparatus comprising:

an image forming apparatus body;

an image forming section disposed interior of said apparatus body for forming an image onto a sheet;

a cassette housing provided in said apparatus body which selectively houses both a feed cassette containing sheets for supply to said image forming section, and a discharge cassette for receiving an image-bearing sheet;

feed transport means for transporting a sheet from said feed cassette to said image forming section; and discharge transport means for transporting the image-bearing sheet to the discharge cassette when contained in said cassette housing.

43. An apparatus according to claim 42, wherein said discharge transport means comprises substantially horizontal transport means including a discharge transport path located along a transverse direction of the apparatus for transporting a sheet from said image forming section, and a return transport means for guiding the sheet when sent from said discharge transport path to beneath said discharge transport path; and said discharge cassette includes a front discharge unit which acquires a sheet transported by said return transport means and transports the sheet toward the front side of the image forming apparatus in order to discharge the sheet out of the apparatus.

44. An apparatus according to claim 43, wherein said front discharge unit comprises a circulatory transport belt which upon acquiring a sheet circulates in said front-to-rear direction of the image forming apparatus in order to discharge a sheet toward said front side, and further comprises means for driving said circulatory transport belt.

45. An apparatus according to claim 44, wherein said discharge cassette includes extractable means for receiving a sheet discharged by said circulatory transport belt.

46. An apparatus according to claim 43, further comprising means for determining whether a cassette contained in said cassette housing is said discharge cassette or said feed cassette.

47. An apparatus according to claim 46, wherein said determination means is able to obtain a sheet-size reading from said feed cassette when installed in said cassette housing; and wherein said determination means determines that the discharge cassette is installed wherein it cannot obtain a sheet-size reading.

48. An apparatus according to claim 47, further comprising;

side discharge means for discharging a sheet from said discharge transport means exteriorly of the image forming apparatus, a switchover member for selectively sending a sheet from said discharge transport means either to said side discharge means or to said return transport means, and means for so controlling said switchover member that a sheet from said discharge transport means is sent to said side discharge means when said detection means determines that the discharge cassette is not installed.

* * * * *